United States Patent [19]

Ketterer

[11] Patent Number: 4,522,135

[45] Date of Patent: Jun. 11, 1985

[54] LOOPER AND CAM ASSEMBLY FOR CHAIN STITCH SEWING MACHINE

[75] Inventor: Stanley J. Ketterer, Jamesburg, N.J.

[73] Assignee: The Singer Company, Stamford, Conn.

[21] Appl. No.: 578,449

[22] Filed: Feb. 9, 1984

[51] Int. Cl.[3] ..... D05B 57/02; D05B 97/02; D05B 97/10

[52] U.S. Cl. ..... 112/199; 112/169

[58] Field of Search ..... 112/165, 166, 169, 197, 112/199, 201

[56] References Cited

U.S. PATENT DOCUMENTS

| | | | |
|---|---|---|---|
| 287,576 | 10/1883 | Post | 112/199 X |
| 1,809,192 | 6/1931 | Cahill et al. | 112/169 |
| 3,165,080 | 1/1965 | Castelletti | 112/169 X |
| 3,837,306 | 9/1974 | Doyel | 112/169 |
| 4,411,210 | 10/1983 | Killinger | 112/199 |

FOREIGN PATENT DOCUMENTS

| | | | |
|---|---|---|---|
| 301697 | 10/1932 | Italy | 112/199 |

*Primary Examiner*—Wm. Carter Reynolds

*Attorney, Agent, or Firm*—William V. Ebs; Robert E. Smith; Edward L. Bell

[57] ABSTRACT

A hand operable chain stitch sewing machine including a pivoted cam and looper assembly with a limited axial position has the looper mounted on the cam so as to deflect axially away from the cam when engaged by the needle of the machine and leave the cam in its limited position wherein cam tracks and a gate therefor are disposed for cooperation with an actuator for the pivoted assembly and a gate spring respectively.

5 Claims, 5 Drawing Figures

LOOPER AND CAM ASSEMBLY FOR CHAIN STITCH SEWING MACHINE

BACKGROUND OF THE INVENTION

1. Field of the Invention

The invention relates to chain stitch sewing machines.

2. Description of the Prior Art

Single thread chain switch sewing machines with pivoted thread seizing loopers are commonly used for sewing buttons onto garments and for hemming or tacking. Such a machine may be seem, for example, in U.S. Pat. No. 4,411,210 of Karl H. Killinger for "Actuating Mechanism for a Double Pointed Looper in a Sewing Machine", issued Oct. 25, 1983.

A machined described in said patent includes a povitably mounted cam having a looper affixed thereto, and spring means which biases the looper cam assembly axially to a position wherein tracks in the cam are disposed for engagement with a cam actuator, and a gate for controlling access to the cam tracks is disposed for engagement with a gate regulating spring. During operation of the machine, the looper is pivoted to bring looper points into cooperation with a sewing needle and so provide for the formation of chain stitches. However, faulty operation of the machine is sometimes experienced due to engagement of the needle with a looper point resulting in axial movement of the looper cam assembly and disengagement of the cam from the actuator and/or the gate from the gate spring.

It is a prime object of the present invention to provide an improved chain stitch sewing machine in which the operation is unaffected by engagement of a sewing needle with a looper point.

It is another object of the invention to provide a chain stitch sewing machine with a pivotably mounted looper and cam assembly on which the looper can be deflected away from the cam without affecting the axial position of the cam in the machine.

Other objects and advantages of the invention will become apparent during a reading of the specification taken in connection with the accompanying drawings.

SUMMARY OF THE INVENTION

A chain stitch sewing machine including a pivoted cam and looper assembly, and spring means which biases the assembly to a limited axial position has the looper formed of a resilient material and mounted on the cam to deflect axially away from the cam if engaged by a looper point by the needle of the machine, and so leave the cam in its limited position wherein cam tracks and a gate therefor are disposed for cooperation with an actuator for the pivoted assembly and a gate spring, respectively.

DESCRIPTION OF THE INVENTION

Figure 1:
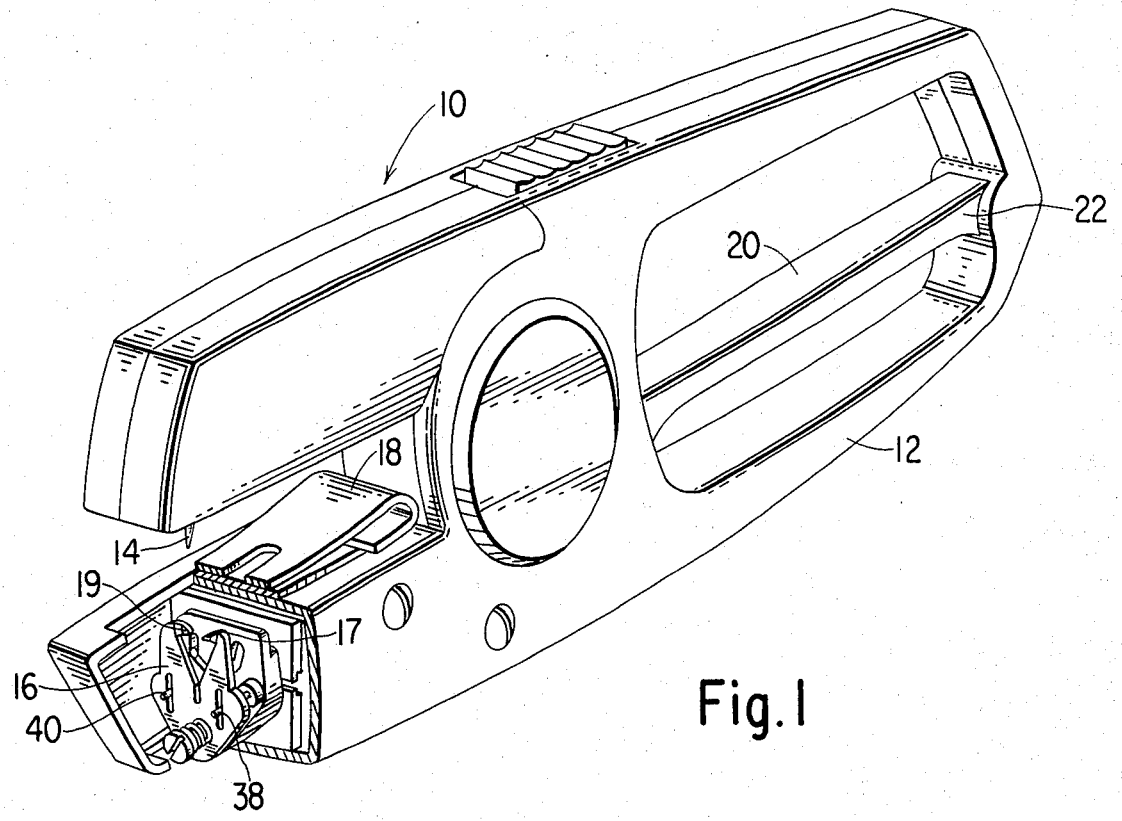
FIG. 1 is a perspective view of a hand operable sewing machine including the arrangement of the invention.
Figure 2:
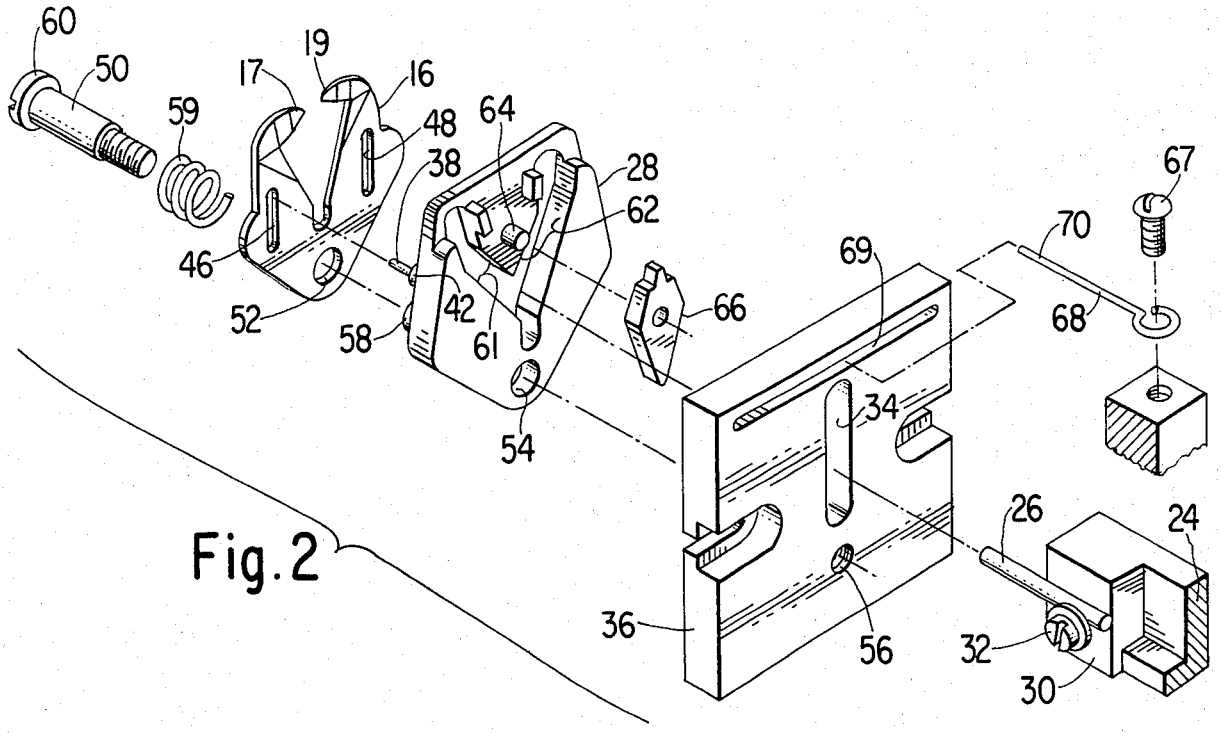
FIG. 2 is an exploded perspective view showing looper actuating mechanism according to the invention.
Figure 4:
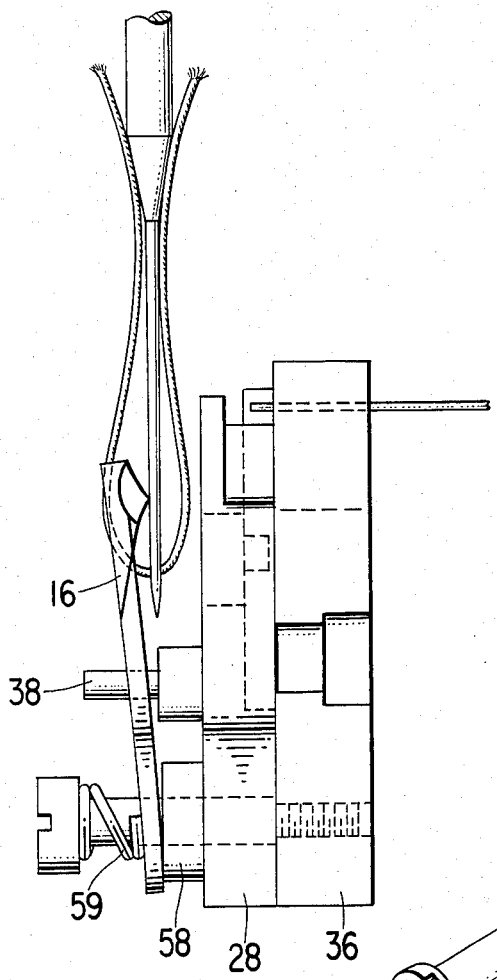
FIG. 4 is an end view of the looper cam assembly.
Figure 3:
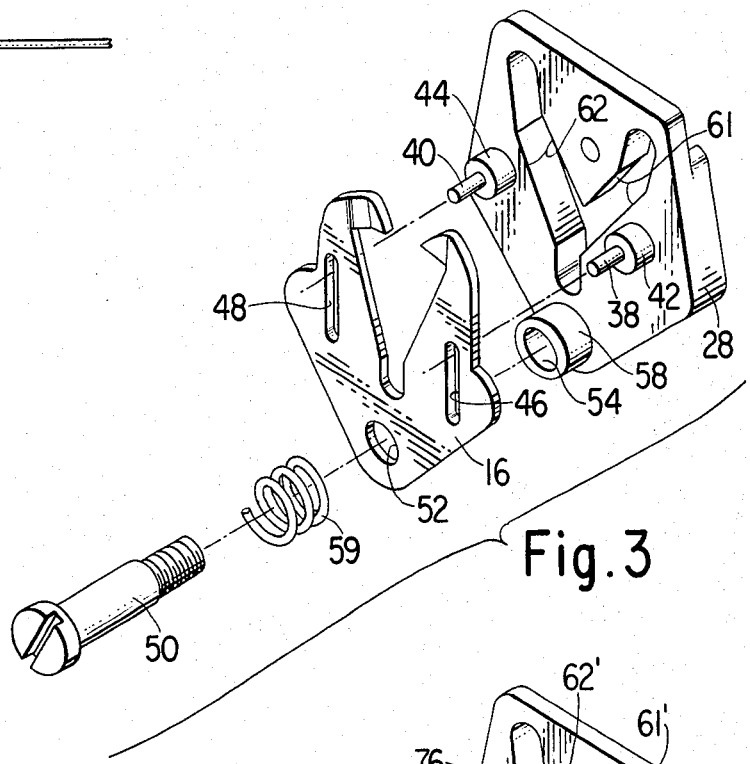
FIG. 3 is an exploded perspective view showing parts of a looper cam assembly according to the invention.

Referring to FIGS. 1 through 4 of the drawings, reference character 10 designates a hand held sewing machine including a frame 12, a thread carrying needle 14 arranged for reciprocating movement, and a pivotally movable looper 16 with opposing loop seizing points 17 and 19 which cooperate with the needle in the formation of chain stitches. A workpiece feed mechanism 18 is arranged to undergo movements in cooperation with those of the needle 14 and the looper 16 in a well known manner, to properly position the work piece. A hand operated lever 20 which is pivotally attached at one end 22 to the frame 12 is interconnected with the needle 14 and feed mechanism 18 to impart the desired movements thereto. Such interconnections may be effected as in the manner shown, for example, in the copending U.S. patent application of Karl H. Killinger for "Feeding Mechanism for a Double Pointed Looper Sewing Machine", filed Jan. 28, 1983 and having Ser. No. 461,825, now U.S. Pat. No. 4,463,695.

The hand operated lever 20 acts through a drive arm 24, (see FIG. 2), an actuator in the form of a drive pin 26 on the arm, and a pivoted cam 28 driven by the actuator to impart movement to the looper 16. The drive pin 26 is held in place on the free end portion 30 of arm 24 by a suitable fastener 32, and extends through an elongated hole 34 in a guide block 36 which is rigidly attached to the frame 12, the elongated hole being arranged to slidingly receive drive pin 26 for the guiding thereof in a vertical plane. The drive pin further extends beyond the guide block to the cam 28 to provide for the actuation of the cam and thereby the looper 16 which is mounted on the cam in accordance with the invention.

Cam 28 has pins 38 and 40 affixed in and extending axially from bosses 42 and 44 respectively, and the looper 16 is formed with elongate slots 46 and 48 to receive the pins 38 and 40. The looper is mounted on the cam with pins 38 and 40 extending through slots 46 and 48 respectively, and the assembly is secured for pivotal movement in the machine with a screw 50 extending through holes 52 and 54 in the looper and cam respectively, and screwed into a threaded hole 56 in block 36. A helical compression spring 59 between the head 60 of screw 50 and the looper 16 biases the looper against bosses 42, 44 and 58 on cam 28, and the cam into sliding engagement with guide block 36. Cam 28 includes two cam tracks 61 and 62 which intersect at their lower extremities and receive an end portion of the drive pin 26 extending through elongate hole 34 in block 36. Pin 26 which is vertically reciprocated by the operation of handle 20, moves along the tracks to impart reciprocatory pivotal motion to the cam. The cam acting through pins 38 and 40 imparts reciprocatory pivotal motion to looper 16. Cam 28 includes a fixed pin 64 which pivotally supports a gate 66 for alternately blocking intersecting cam tracks 61 and 62, so that drive pin 26 can move between the tracks to effect pivotal movement of the cam as described in the aforementioned U.S. Pat. No. 4,411,210, and alternately place each of the two loop seizing points 17 and 19 on the looper into cooperative association with needle 14 to provide for the formation of chain stitches. The gate is positioned in the manner fully described in the said U.S. Pat. No. 4,411,210, with the aid of a gate regulating spring 68 affixed at one end in the machine with a screw 67 and extending through a slot 69 in block to dispose the free end 70 of the spring for engagement with the gate. Chain stitches are formed by the looper in a manner which is well understood in the art, and in accordance with which the looper points are caused to alternately seize and hold onto a needle carried loop of thread until the needle can pierce the held loop with a new loop.

During the formation of chain stitches, the looper points 17 and 19 may be engaged on the rear side of the looper by needle 14, and the looper which is of a resilient material such as sheet steel is then deflected away from cam 28 by the needle. The looper is deflected in the manner indicated in FIG. 4 while guided by pins 38 and 40. As shown, the looper deflects to an increasing degree upwardly from the low end which is held against boss 58 by spring 59. Cam 28 and gate 66 are maintained in sliding engagement with guide block 36 by the compressive action of spring 59 during deflection of the looper. The spatial relationship between actuator 26 and cam tracks 61 and 62, as well as between spring 68 and gate 66 is therefor unaffected by the deflection of looper 16 and uninterrupted operation of the machine is assured. This is in contrast to machines (as shown, for example, in U.S. Pat. No. 4,411,210), in which the looper and cam can only move as a unit, and in which engagement of the needle with the looper may therefor cause the cam and gate to separate from the actuator and gate spring respectively, and so result in faulty operation of the machine.

Figure 5:
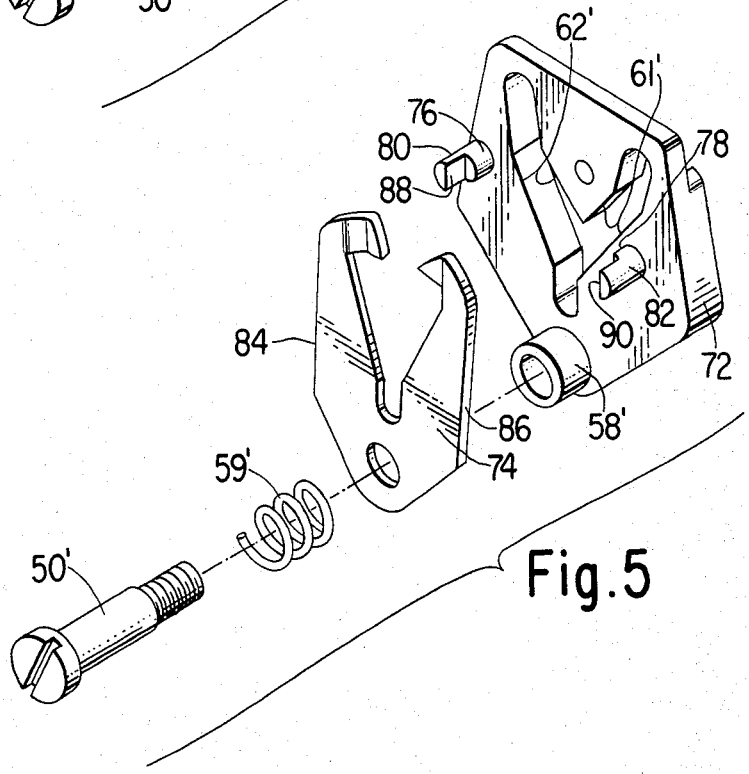
FIG. 5 is an exploded view showing parts of a modified looper cam assembly according to the invention.

An alternate version of a chain stitching machine according to the invention includes a cam 72 in place of cam 28, and a looper 74 in place of the looper 16 as shown in FIG. 5. Cam 72 includes tracks 61' and 62' corresponding to the tracks 61 and 62, respectively, in cam 28, and a boss 58' corresponding to boss 58 in cam 28. Cam 72 also includes bosses 76 and 78 with flat sided extending portions 80 and 82, respectively. Looper 74 is formed with straight edge portions 84 and 86 which are engaged by flat sides 88 and 90 respectively, of extending boss portions 80 and 82 in the mounted positions of the looper 74 on cam 72. The looper and cam are assembled and secured for pivotal motion in the machine with a screw 50' and spring 59' in the manner already described for cam 28 and looper 16. Looper 74 is pivoted by the embracing cam 72 when the cam is actuated, and whenever the looper is engaged by the needle of the machine, the looper deflects away from the cam as previously described while guided by engagement with the embracing flat sides of bosses 76 and 78. The axial position of the cam is left undisturbed and faulty operation is prevented.

It is to be understood that the present disclosure relates to preferred embodiments of the invention which are for purposes of illustration only, and are not to be construed as limiting the invention. Numerous alterations and modifications of the structures herein disclosed will suggest themselves to those skilled in the art, and all such modifications and alterations which do not depart from the spirit and scope of the invention are intended to be included within the scope of the appended claims.

I claim:

1. In a sewing machine; a needle; a frame; means mounted in the frame for reciprocating the needle; a looper and cam assembly, the looper being of a resiliently flexible material and having a loop seizing point, and said cam including a cam track; resilient means biasing the looper and cam assembly into a limited position in the frame; an actuator engageable with the cam on said cam track in the limited position of the assembly for imparting pivotal movement to said assembly and disposing the looper point for cooperation with the needle in the formation of stitches; the looper being mounted on said cam to resiliently deflect away from the cam upon engagement of said loop seizing point with the needle, and leave the cam in said limited position, said cam having axially projecting members thereon which embrace the looper to prevent the looper from pivoting relative to the cam while permitting the looper to deflect axially relative to the cam.

2. In a sewing machine; a needle; a frame; means mounted on the frame for reciprocating the needle; a looper and cam assembly, the looper being of a resiliently flexible material and being formed with a pair of loop seizing points, the cam including a pair of intersecting cam tracks and said cam having a gate pivotally mounted thereon; resilient means biasing the looper and cam assembly axially into a limited position in the frame; an actuator engageable with the cam on said cam tracks in the limited position of the assembly for imparting pivotal movement to said assembly and disposing the looper points for cooperation with the needle in the formation of chain stitches; and a spring having one end affixed within the frame and the other end engageable with the gate in the limited position of the cam for moving the gate into positions controlling actuator movement between the cam tracks; the looper being mounted on said cam to resiliently deflect away from the cam upon engagement of a loop seizing point with the needle, and leave the cam in its limited position wherein the cam tracks are engageable by the actuator and the gate is engageable by said spring, the cam being provided with axially projecting members which extend into sliding engagement with the looper from spaced apart locations on the cam to guide deflection of the looper while preventing pivotal movement thereof relative to the cam.

3. The combination of claim 2 wherein the looper has elongate holes formed therein, and said axially projecting members are received in the holes to guide deflection of the looper away from the cam and prevent relative pivotal movement of the looper and cam.

4. The combination of claim 2 wherein said axially projecting members embrace the looper to prevent the looper from pivoting relative to the cam while permitting the looper to deflect axially relative to the cam.

5. The combination of claim 4 wherein the axially projecting members are bosses with flat sides in engagement with the looper.

* * * * *